US006415875B1

(12) United States Patent
Meixner et al.

(10) Patent No.: US 6,415,875 B1
(45) Date of Patent: Jul. 9, 2002

(54) HAND-HELD POWER TOOL

(75) Inventors: Gerhard Meixner, Filderstadt; Ludwig Thome, Leinfelden-Echterdingen; Felix Blank, Esslingen; Georg Hansis, Bonn; Thomas Klaas, Geislingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/482,134

(22) Filed: Jan. 12, 2000

(30) Foreign Application Priority Data

Jan. 12, 1999 (DE) ..... 199 00 882

(51) Int. Cl.[7] ..... B25F 5/00

(52) U.S. Cl. ..... 173/2; 173/176; 173/217; 173/171

(58) Field of Search ..... 173/2, 176, 217, 173/171, 104, 109, 200, 201, 48, 213, 117, 20

(56) References Cited

U.S. PATENT DOCUMENTS 3,454,111 A * 7/1969 Neiss ..... 173/176
4,029,159 A * 6/1977 Nymann ..... 173/217
4,448,261 A * 5/1984 Kousek et al. ..... 173/176
5,085,280 A * 2/1992 Rassieur ..... 173/176
5,401,124 A * 3/1995 Hettich ..... 173/176
5,947,212 A * 9/1999 Huang ..... 173/216
5,996,707 A * 12/1999 Thome et al. ..... 173/217

FOREIGN PATENT DOCUMENTS

DE 195 40 718 A1 11/1995
EP 0 841 127 A2 5/1998

* cited by examiner

*Primary Examiner*—Scott A. Smith
(74) *Attorney, Agent, or Firm*—Michael J. Striker

(57) ABSTRACT

A hand-held power tool has a machine housing, a drive motor, a tool receptacle, a drive strand accommodated in the machine housing and extending between the drive motor and the tool receptacle, and a detection device for detecting an uncontrolled operational condition of the hand-held power tool, and a blocking device which in case of the uncontrolled operational condition form-lockingly connects the drive strand with the machine housing, the blocking device including at least one locking member which is housing-fixed in a rotary direction of the drive strand and at least one locking member which co-rotates in the drive strand so that the locking member and the blocking member are bringable in engagement with one another, the locking member and the blocking member being bringable in engagement with one another axially in direction of a rotary axis of the blocking member.

12 Claims, 5 Drawing Sheets

HAND-HELD POWER TOOL

BACKGROUND OF THE INVENTION

The present invention relates to hand-held power tools.

One of such hand-held power tools is disclosed for example in the German patent document DE 195 407 18 A1, in which a drive strand in uncontrolled operational situation, such as for example the situation which can occur during a sudden turning of a machine housing after fixing of the tool, is blocked with a machine housing with a jerk. The hand-held machine tool for this purpose is designed with a detecting device which recognizes the uncontrolled operational condition and then form lockingly connects a blocking device of the drive strand with the machine housing. The blocking device for this purpose has a locking member which is displaceably supported in the machine housing radially in direction of the drive member in the drive strand, and is bringable radially into the form-locking engagement with a locking toothing formed on the drive member. The disadvantage of this solution is that the radial arrangement of the locking member to the locking toothing requires a relatively great radial space. The engagement of the locking member is performed relatively close to the rotary axis of the drive strand, so that high blocking forces act on the locking member and require an especially stable design of the blocking device. Moreover, relatively high disengaging forces are required to bring the blocking member after the blocking of the drive strand with the machine housing, again out of the engagement with the locking toothing.

SUMMARY OF THE INVENTION

Accordingly, it is an object of present invention to provide a hand-held power tool which avoids the disadvantages of the prior art.

In keeping with these objects and with others which will become apparent hereinafter, one feature of present invention, resides, briefly stated, in that the locking member and the blocking member are bringable in engagement with one another axially in direction of a rotary axis of the blocking member.

When the hand-held power tool is designed in accordance with the present invention, the inventive arrangement of the locking member and the blocking member provides for a lowering of the structural loads caused by their engagement. In addition it is guaranteed that the blocking device after the release of the blocking device is again bringable to its initial position in a disturbance free manner. Moreover, the axial arrangement of the blocking device provides a flexible and space-saving design of the hand-held power tool.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
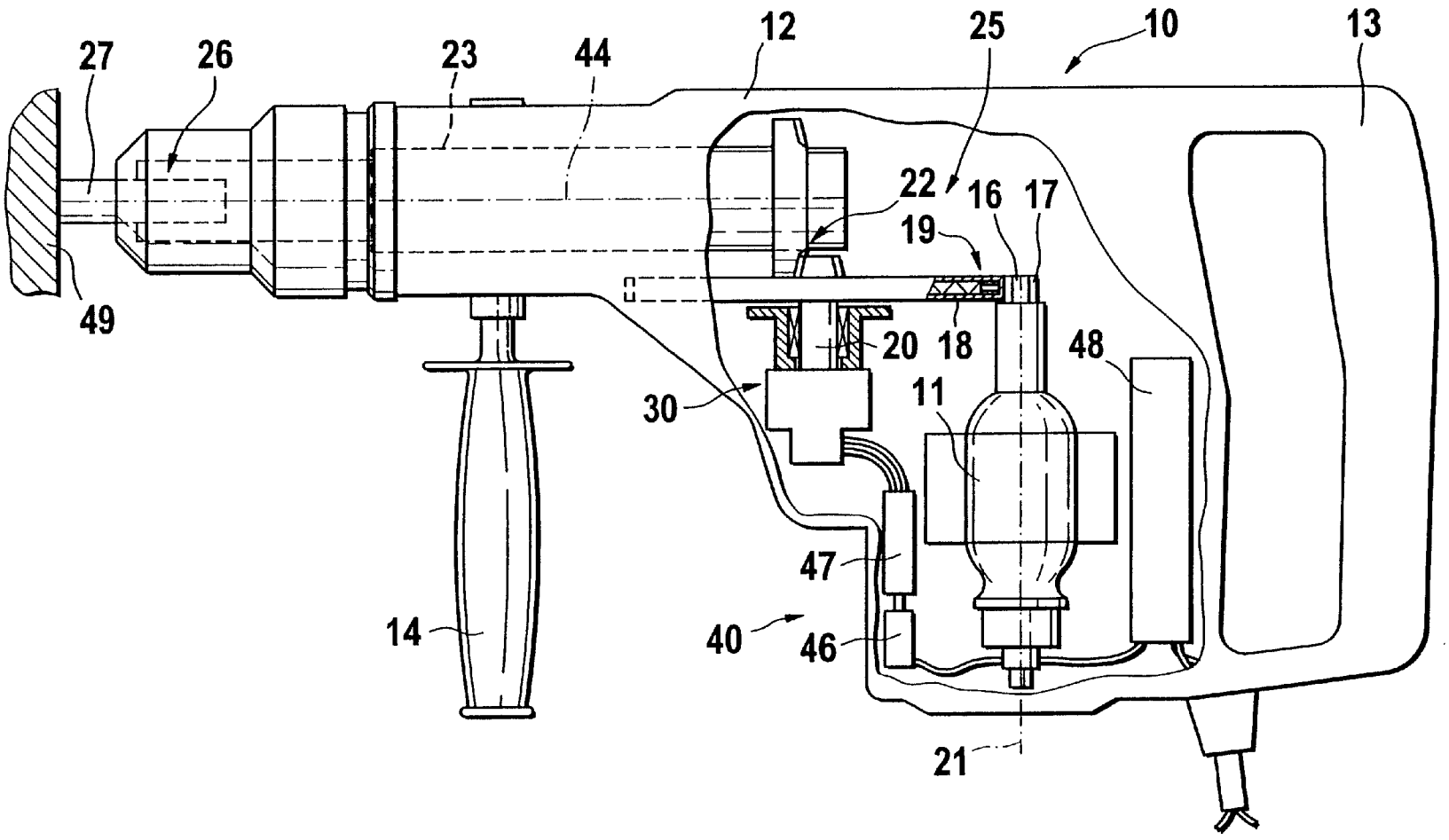
FIG. 1 is a view showing a longitudinal section of a power drill in accordance with the present invention.

A power drill 10 shown in FIG. 1 is an example of a hand-held power tool which is designed in accordance with the present invention. The power drill 10 has an electric drive motor 11 which is arranged inside a machine housing 12. The drive motor 11 has a motor shaft 16 which is rotatable about a motor axis 21. A handle 13 and an auxiliary handle 14 are arranged on the machine housing 12.

A drive torque which is taken from the drive motor 11 is transmitted from a pinion 17 arranged on the motor shaft 16 to a toothed gear 18. From the toothed gear 18 the torque is transmitted through an overload clutch 19 to an immediate shaft 20. The intermediate shaft 20 located substantially parallel to the motor axis 21 is in a transmission connection via a bevel gear transmission 22 with a drilling spindle 23. The drilling spindle 23 at one side is provided with a two receptacle 26 for a drilling tool 27 for working a workpiece 49. The parts including the motor shaft 16, the pinion 17, the tooth gear 18, the overload clutch 19, the intermediate shaft 20, the bevel gear transmission 22, and the drilling spindle 23 form drive members of a drive strand 25 for rotatable drive of the tool receptacle 26, and correspondingly for the drilling tool 27 received in it. The machine housing 12 and the drilling spindle 23 can be additionally received in a not shown impact mechanism so that the power drill 10 can be used also as an impact-drilling machine, for example as a hammer drill.

A blocking device 30 for the drive strand of the power drill 10 is arranged in the machine housing 12. The blocking device 30 is controllable by a detection device 40. The detection device has a sensor 46 which is formed as an acceleration sensor and an evaluating device 47. The detection device 40 is formed for this purpose so that it recognizes an uncontrolled operation condition of the power drill 10, and in this case outputs an electrical output signal to the blocking device 30. The blocking device, which will be explained herein below with several embodiments, makes possible coupling of the drive strand 25 with the machine housing 12 in a form-locking manner, so that the drive strand 25 is blocked. In this way the drilling tool 27 is non rotatably connected with the machine housing 12. With the drilling tool 27 which is fixed in the workpiece 49 it is therefore prevented that the power drill 10 is accelerated around a longitudinal axis 44 of the drilling spindle 23. The overloading clutch 19 located between the blocking device 30 and the drive motor 11 prevents in the case of blocking that a drive torque is transmitted to the intermediate shaft 20 or to the drilling spindle 23. Via a motor control 48, the drive motor 11 in the case of blocking is turned off.

Figure 2:
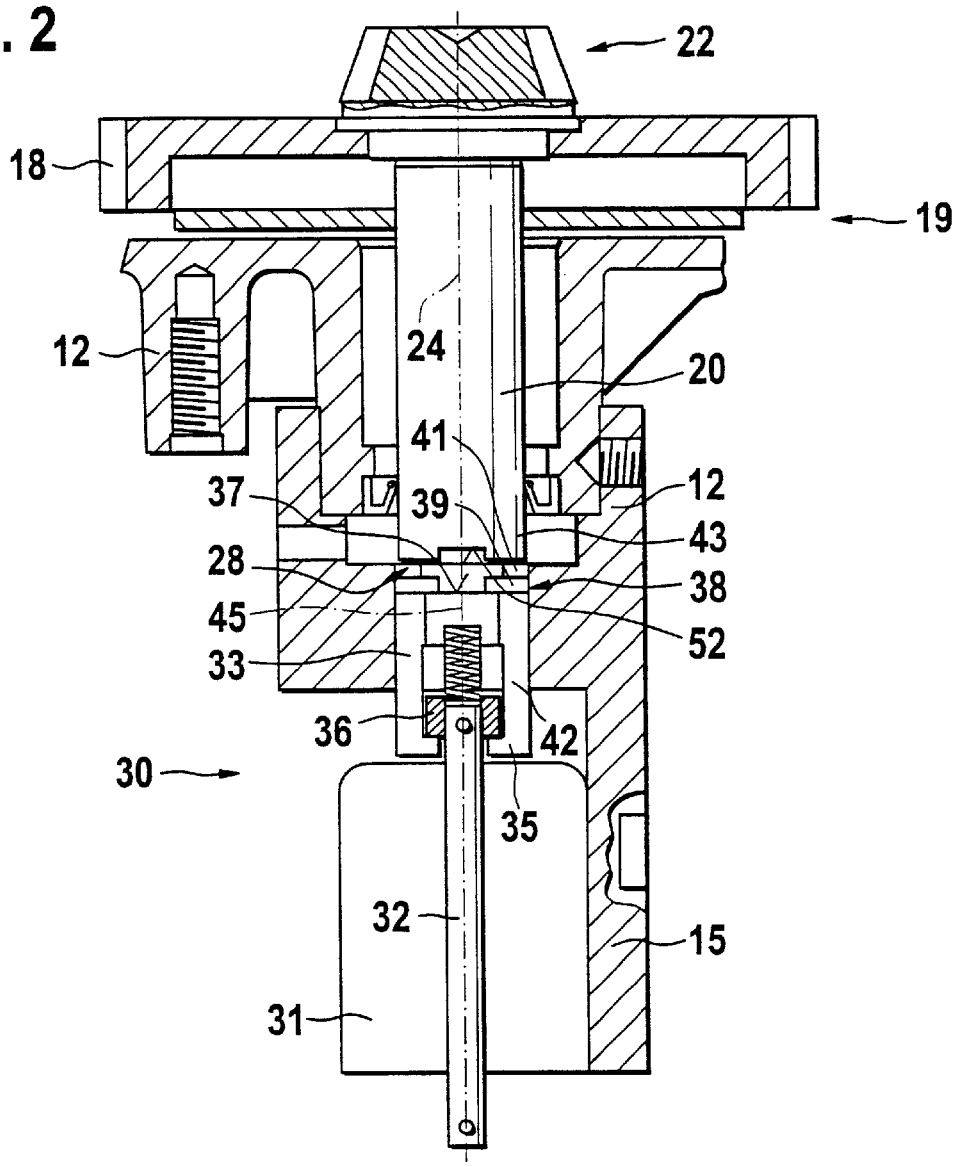
FIG. 2 is a view showing a section through a blocking device of the power drill in accordance with a first embodiment.

FIG. 2 shows a first embodiment of a blocking device 30. In this and other embodiments the same and identically operating parts are identified with the same reference numerals. The blocking device 30 has an electromagnet 31 which is mounted on a housing part 15 fixed in the machine housing 12. The electromagnet 31 is formed as a bipolar stroke magnet. It can reciprocate a switching rod 32 which forms a magnet armature, between two axial end positions. In FIG. 2 the switching rod 32 is shown in a disengaged position, in which the drive strand 26 is not blocked.

The switching rod 32 is arranged symmetrically in extension to the intermediate shaft 20 and coincide with the intermediate shaft 20. The switching rod 22 carries a locking member 33 at its end which faces the intermediate shaft 20. The locking member 33 is articulated axially displaceably to the switching rod 32 and is held by a pressure spring 34*a* in a forward position facing the intermediate shaft 20. The locking member 33 at its end facing away from the intermediate shaft 20 has an inwardly extending collar 35 which engages behind an axially fixed locking block 36 at the end of the switching rod 32. The locking member 33 is displaceable thereby axially within certain limits against the force of the pressure spring 34*a* on the switching rod 32. A strip-shaped projection 42 on the locking member 33 engages radially in a guiding groove 41 in the housing part 15 and forms in this way a rotation securing for the locking member 33 against the machine housing 12.

The locking member 33 at its end side 37 which faces the intermediate shaft 20 carries a locking toothing 38 which is composed of a plurality of locking teeth 39. The locking member 33 is located opposite to a blocking member 33 which is provided with a blocking toothing 28 composed of a plurality of blocking teeth 29. The blocking toothing 28 is formed at the end side 52 of the intermediate shaft 20 facing away from the bevel gear transmission 22, so that the blocking member 43 in this case is formed by the intermediate shaft 20. The blocking member 43 and the locking member 32 form a joint engaging axis 45 which coincides with the rotary axis 24 of the blocking member 43. In the shown example the blocking member 43 has the same rotary axis 24 as the intermediate shaft 20.

Figure 3:
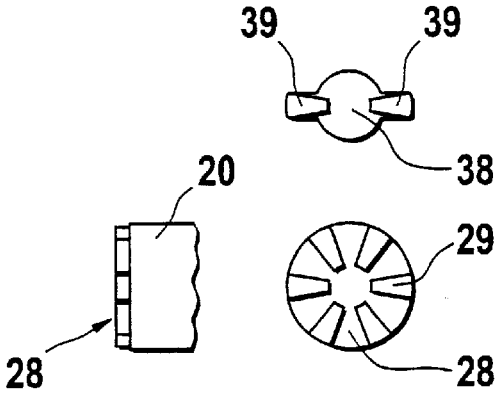
FIGS. 3 and 4 are views showing different tooth pairs of the blocking member and locking member in accordance with the first embodiment.

FIG. 3 shows a first embodiment of a toothed pair 28, 38. Here the locking toothing 38 is formed by two opposite locking teeth 39, while the blocking toothing 28 includes six blocking teeth 29 which are uniformly distributed over the end side of the intermediate shaft 20. The locking teeth 39 and the blocking teeth 29 reduce conically radially inwardly toward the engaging axis 45.

Figure 4:
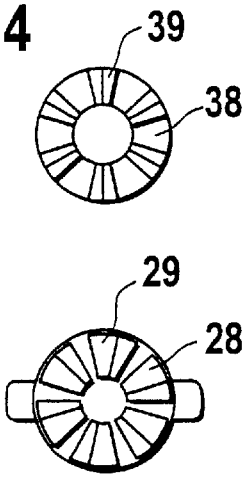

FIG. 4 shows a second embodiment of a toothed pair 28, 38. Here the blocking toothing 28 also includes total six blocking teeth 29, while the locking toothing 38, instead of two, also has six locking teeth 39. Due to the high tooth number, the loading of the locking member 33 is increased when compared with the embodiment with two teeth only.

In both cases the blocking device 30 operates identically. In the blocking case the electromagnet 31 is controlled by the evaluating device 47 so that the switching rod 32 is displaced in direction of its second end position (blocking position) axially to the blocking toothing 28. Since the locking member 32 and the locking rod 32 are coupled with one another with an axial gap, the switching rod 32 reaches its end position regardless of whether the locking toothing 38 actually engages with the rotatable blocking toothing 28. Due to the pretensioning of the pressure spring 34, the locking member 33 is forced in direction into the blocking toothing 28, so that the locking toothing 38 after short relative turning of the blocking member is engaged with the blocking toothing 28.

For relasing the blocking engagement of the locking toothing 38 and the blocking toothing 28, the electromagnet 31 obtains a corresponding disengaging signal from the evaluating device 47, with which the switching rod 32 is displaced axially back to its initial position (disengaging position). The pulling rod 32 pulls the locking member 33 through the form lock of the ring collar 35 and the locking block 36 from the form-locking engagement with the blocking toothing 28. Due to the symmetrical axial arrangement of the blocking toothing 28 and the locking toothing 38 with formation of a plurality of teeth 29, 39, the loading of each individual tooth 29, 39 is reduced and a clamping of the toothing 28, 38 with one another can be reduced and can be counteracted. In this way a disturbance-free automatic return of the locking member 33 to its initial position is always guaranteed.

Figure 5:
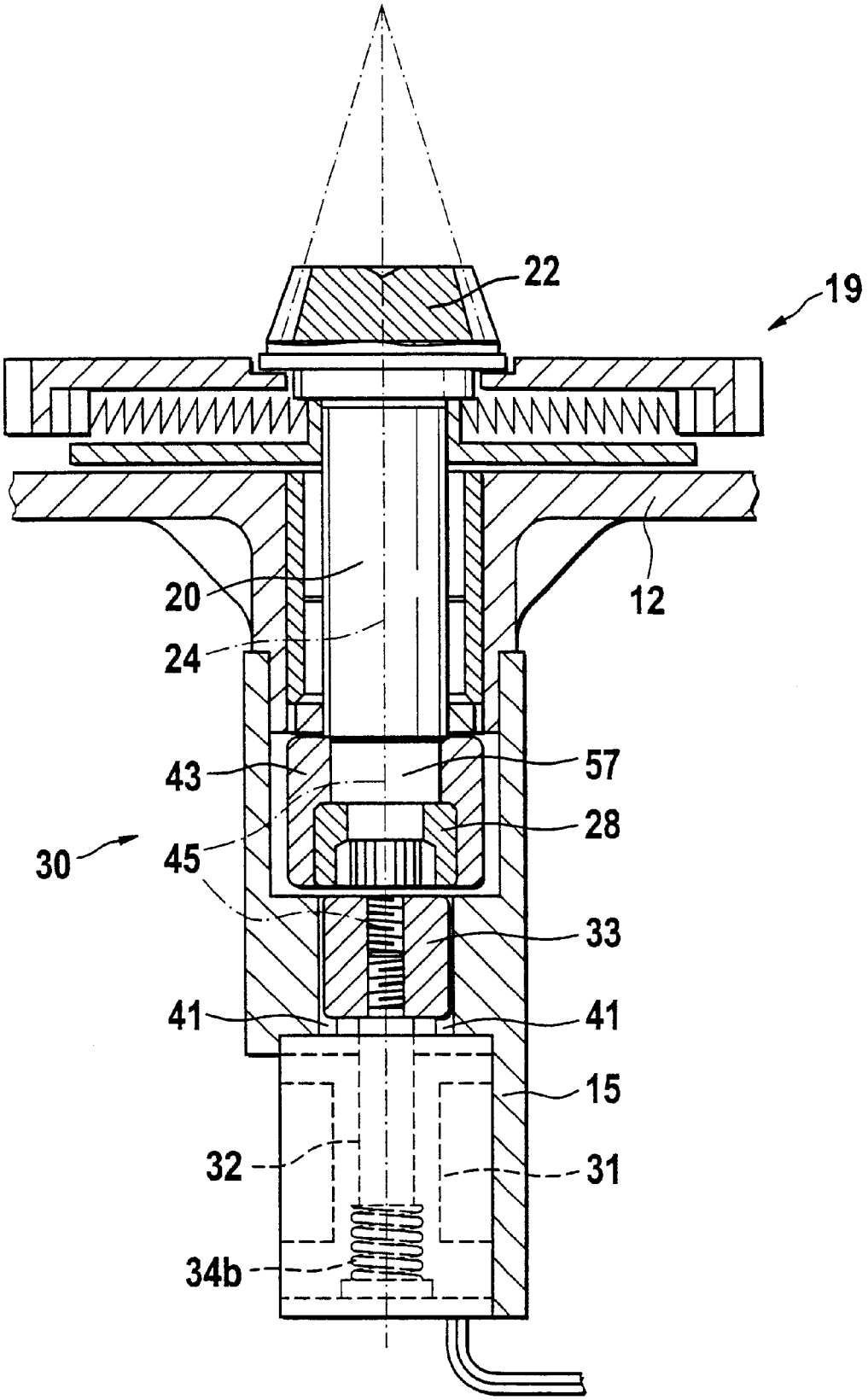
FIG. 5 is a view showing a section through a blocking device in accordance with a second embodiment.

FIG. 5 shows a second embodiment of the blocking device 30. Also in this embodiment the engaging axis 45 coincides with the rotary axis 24 of the blocking member 43. In other words, the locking member is arranged symmetrically to the blocking member 43. The electromagnet 31 is formed however as a one-pole electromagnet. In other words, the switching rod 32 is loaded with a spring force.

In the embodiment of FIG. 5, the switching rod 32 is loaded by a pressure spring 34*b* which forces the switching rod 32 to a blocking-free initial position. For engaging of the locking member 33 the electromagnet 31 is supplied with current, so that the switching rod 32 is displaced opposite to the spring force of the pressure spring 34*b* in direction to the blocking member 43, and the locking member 33 is brought in engagement with the blocking toothing 28.

Figure 6:
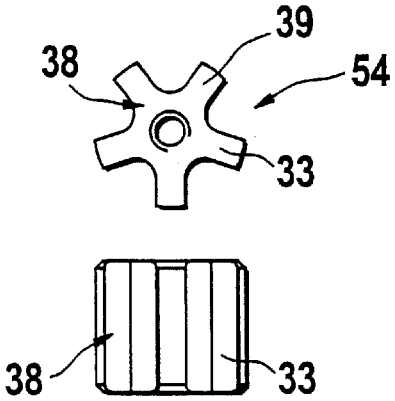
FIG. 6 shows two views of the locking member of FIG. 5.

The switching rod 32 carries the locking member 33 axially fixedly through a thread connection. The locking member 33 is provided with an outer toothing 54 which includes five radially projecting locking teeth 39 shown in FIG. 6. The locking member 33 is secured from rotation relative to the machine housing 12 by the locking teeth 39, of which two engage in the longitudinal grooves 41, and the housing part 15.

Figure 7:
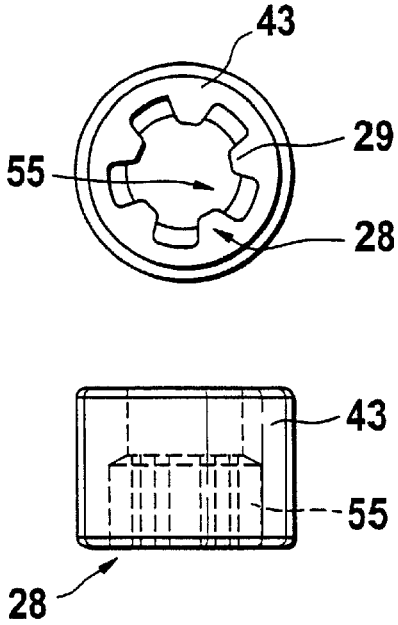
FIG. 7 is a view showing two views of the blocking member of FIG. 5.

The blocking toothing 28 is formed on a separate blocking member 43 which is coupled with the intermediate shaft 20 in non rotatable manner. The blocking member 43 for this purpose is pressed on a pin 57 which is arranged at the one side on the intermediate shaft 20. The blocking toothing 28 is formed as an inner toothing 55 in the blocking member 43 as shown in FIG. 7. The blocking teeth 29 extend correspondingly radially inwardly.

The operation of the blocking device 30 is similar to the first embodiment. When the detection device 40 recognizes an uncontrolled operational case, the electromagnetic 31 is correspondingly controlled. In this case, it is sufficient to interrupt current to the electromagnet 31 so that the magnetic pulling action causes a displacement of the switching rod 32 and the locking member 33 is axially displaced in direction to the blocking toothing 28. After a short relative turning between the rotatable blocking member 43 and the locking member 33 fixed in the housing part 15 in the rotary direction of the blocking member 43, the locking toothing 28 and the blocking toothing 28 engage with one another. Thereby the intermediate shaft 20 is non rotatably connected with the machine housing 12.

For disengagement of the locking member 33, the electromagnet 31 is again correspondingly controlled by interrupting the current, so that the pretensioning of the pressure spring 34*b* forces the switching rod 32 to its initial position shown in FIG. 5.

I n this embodiment it is advantageous with the sufficiently great diameter of the blocking toothing 38 of the blocking member 43, the outer surface of the blocking member 43 is available as an operation support, for example for bearing and sealing purposes, and thereby a small axial extension of the blocking member 43 or the intermediate shaft 20 is provided. Since the blocking force is distributed simultaneously over all blocking teeth, the corresponding surface pressure on each tooth is optimally small.

Figure 8:
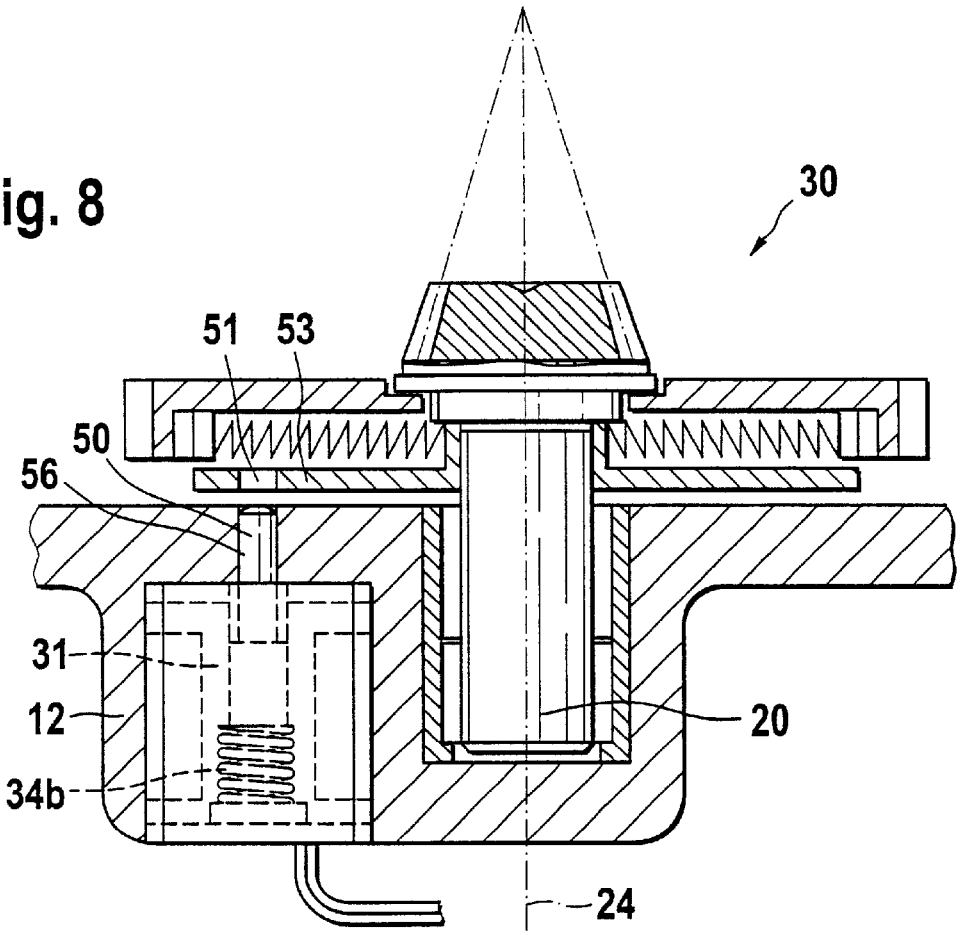
FIG. 8 is a view showing a section through a blocking device in accordance with a third embodiment of the invention.

FIG. 8 shows a third embodiment of the blocking device 30. In contrast to the both preceding embodiments, here the engagement axis 45 extend parallel to the rotary axis 24 of the blocking member 43. The electromagnet 31 with the switching rod 32 is offset correspondingly parallel to the rotary axis 34.

The locking member 33 is pin-shaped and formed directly by the engagement-side end of the switching rod 32. The switching rod 32 is loaded by the pressure spring 34*b* opposite to the engaging direction with a force. The blocking toothing 28 is formed by a plurality of pieces 51 which are distributed in a ring disk 53 uniformly in the peripheral direction. The ring disk 53 is non rotatably connected with the intermediate shaft 20. The ring disk 53 can be simultaneously formed as an output-side drive part in the overload clutch 19, so that an additional component can be saved.

Figure 9:
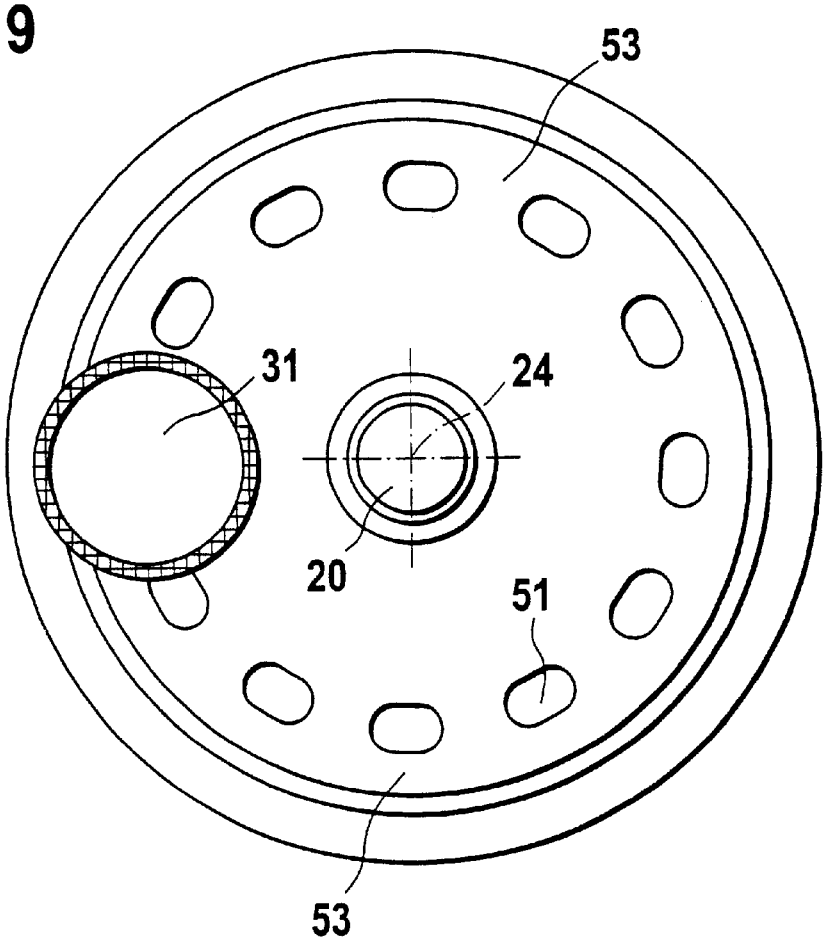
FIG. 9 is a plan view of the blocking member of FIG. 8.

FIG. 9 shows the ring disk 53 on a plan view. The recesses 51 which are uniformly distributed in the peripheral direction of the ring disk 53 can be clearly recognized. They are formed as elongated openings. The electromagnets 31 is offset parallel to the rotary axis 24 of the intermediate shaft 20. Because of the parallel offset of the rotary axis 24, the pin 50 which forms locking members 33 does meet here any rotation safety measures relative to the housing part 12. Because of the relatively great radial distance from the rotary axis 24 of the blocking member 43, the blocking forces which act on the locking member 43 and the blocking member 43 are reduced, so that a single locking member 33 is sufficient. The dimension of the radial distance has moreover the advantage that within a predetermined reaction time of the blocking device 30, the rotary angle covered by the blocking member 33, due to the great number of the recesses 51 corresponding to the locking teeth of the blocking toothing, is shorter. Because of a lower number of components, a very compact and cost-favorable solution is thereby provided.

Figure 10:
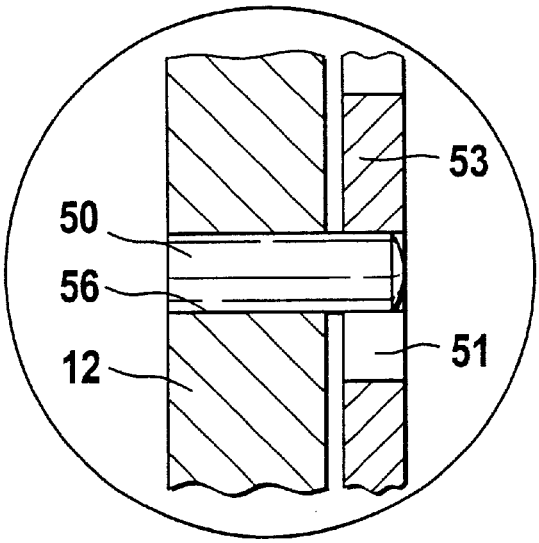
FIG. 10 is a partial section through the blocking device of FIG. 8.

FIG. 10 shows the ring disk 53 which is formed-lockingly non rotatably fixed by the pin 50. The pin 50 extends through the machine housing 12 or the housing part connected with it. The locking member 33 is longitudinally displaceably guided in a passage 56 in the machine housing 12. Because of the asymmetrical arrangement, the blocking device 30 with the ring disk 53 in accordance with the third embodiment can be directly provided on the drilling spindle 23 of the power drill 10, regardless of the impact drive arranged conventionally in the extension of the drilling spindle 23.

The invention is not limited to a power drill, but of course can be used for other handheld power tools such as for example angle grinders, etc.

It will be understood that each of the elements described above, or two or more together, may also find a useful application in other types of constructions differing from the types described above.

While the invention has been illustrated and described as embodied in hand-held power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A hand-held power tool, comprising a machine housing; a drive motor; a tool receptacle; a drive strand accommodated in said machine housing and extending between said drive motor and said tool receptacle; a detection device for detecting an uncontrolled operational condition of the hand-held power tool; and a blocking device which in case of the uncontrolled operational condition form-lockingly connects said drive strand with said machine housing, said blocking device including at least one locking member which is housing-fixed in a rotary direction of said drive strand and at least one blocking member which co-rotates in said drive strand so that said locking member and said blocking member are bringable in engagement with one another, said locking member and said blocking member being bringable in engagement with one another axially in direction of a rotary axis of said blocking member.

2. A hand-held power tool as defined in claim 1, wherein said machine housing is provided with a housing-fixed component, said blocking device in the uncontrolled operational condition of said drive strand being form-lockingly connected with said housing-fixed component.

3. A hand-held power tool as defined in claim 2, wherein said locking member has a locking toothing provided with a plurality of blocking teeth, said blocking member device being provided with a blocking toothing having a plurality of blocking teeth.

4. A hand-held power tool as defined in claim 3, wherein said locking toothing and said blocking toothing are formed at end sides of said locking member and said blocking member, said locking teeth and said blocking teeth extending axially.

5. A hand-held power tool as defined in claim 3, wherein said locking toothing and said blocking toothing are formed as radial toothings, said locking teeth and said blocking teeth being oriented radially and formed as inner teeth and outer teeth correspondingly.

6. A hand-held power tool as defined in claim 3, wherein said locking member is coupled with a switching rod and is axially displaceable as a magnet armature of an electromagnet.

7. A hand-held power tool as defined in claim 6, and further comprising a pressure spring arranged between said locking member and said switching rod so as to load said locking member in a direction toward said blocking member with an engaging force.

8. A hand-held power tool as defined in claim 6, wherein said locking member is connected fixedly with said switching rod, and said switching rod being loaded by pressure spring in direction toward said blocking member with an engaging force.

9. A hand-held power tool as defined in claim as defined in claim 1, wherein said locking member forms with said blocking member an engagement axis which coincides with the rotary axis of the blocking member.

10. A hand-held power tool as defined in claim 1, wherein said locking member forms with a blocking member an engaging axis which is offset parallel to the rotary axis of said blocking member.

11. A hand-held power tool as defined in claim 10, wherein said blocking member is disk-shaped and provided with a plurality of end-side recesses which are uniformly distributed in a peripheral direction of said blocking member, said recesses being axially engagable with said locking member.

12. A hand-held power tool as defined in claim 11, wherein said locking member is formed by a pin which is formed at an engaging side on said switching rod, said machine housing having a passage in which said locking member is longitudinally displaceable guided.

* * * * *